US006036302A

United States Patent [19]

Hotomi

[11] Patent Number: 6,036,302

[45] Date of Patent: Mar. 14, 2000

[54] INKJET RECORDING APPARATUS

[75] Inventor: Hideo Hotomi, Nishinomiya, Japan

[73] Assignee: Minolta Co., Ltd., Osaka, Japan

[21] Appl. No.: 09/019,478

[22] Filed: Feb. 5, 1998

[30] Foreign Application Priority Data

Feb. 6, 1997 [JP] Japan ..... 9-024015

[51] Int. Cl.[7] ..... B41J 2/04

[52] U.S. Cl. ..... 347/55

[58] Field of Search ..... 347/55, 154, 103, 347/123, 111, 159, 127, 128, 17, 141, 120, 151, 48, 20, 84, 68, 70, 21, 72

[56] References Cited

U.S. PATENT DOCUMENTS 3,946,398 3/1976 Kyser et al. .
5,477,249 12/1995 Hotomi .
5,726,522 3/1998 Hashimoto .
5,854,528 12/1998 Nishikura et al. .

FOREIGN PATENT DOCUMENTS 0-437062 7/1991 European Pat. Off. .

*Primary Examiner*—John E. Barlow
*Assistant Examiner*—Raquel Yvette Gordon
*Attorney, Agent, or Firm*—Sidley & Austin

[57] ABSTRACT

An apparatus and method are disclosed for inkjet printing which includes a piezoelectric member which deforms in response to a voltage to discharge an ink drop, as well as a device for generating an electric field for stabilizing the flight of the ink drop. Additional features include switching the electric field in accordance with image data so that printing large ink drops are stabilized and ink drop anomalies are reduced, while printing of small drops is accomplished without an electric field.

26 Claims, 7 Drawing Sheets

FIG. 5
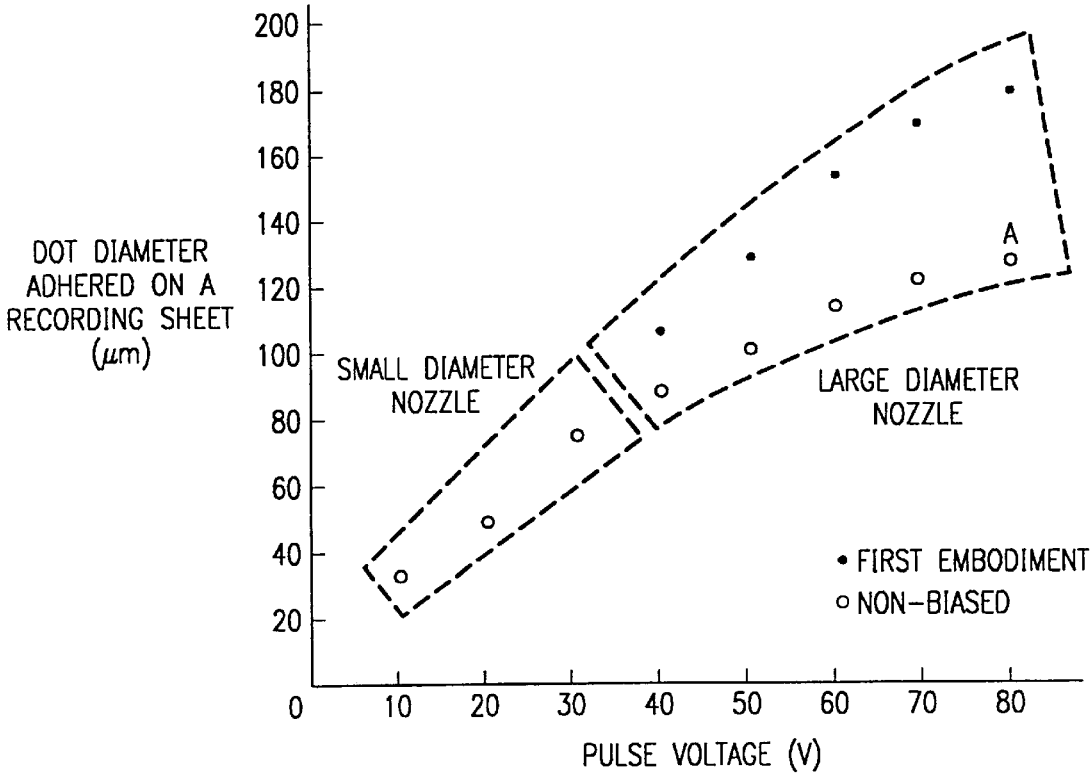
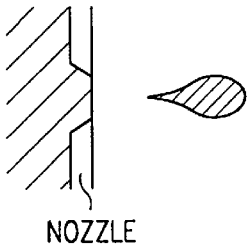
FIG. 6(a)
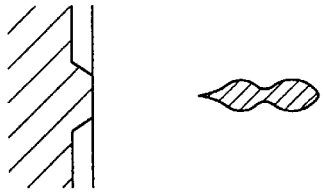
FIG. 6(b)
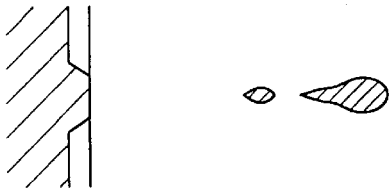
FIG. 6(c)

INKJET RECORDING APPARATUS

FIELD OF THE INVENTION

The present invention relates to an inkjet recording apparatus. The present invention relates, in particular, to an inkjet recording apparatus which accomplishes recording by generating ink drops of different sizes using a piezoelectric drive element which is operated in conjunction with an electrostatic field.

BACKGROUND OF THE INVENTION

Conventionally, there have been inkjet printers in which a piezoelectric element is used for a drive element in the printhead. In such a printhead, a voltage is applied to the piezoelectric element which deforms in response, thereby pressurizing ink contained in an ink channel. The pressurized ink is ejected in the form of an ink drop toward a recording sheet from a nozzle which is provided corresponding to the ink channel. Further, by varying the diameters of the ink drops, a gradation of printing densities can be expressed.

Currently, there is under development a printhead for ejecting an ink drop which produces an ink spot whose diameter is within a range of about 35 $\mu$m to 120 $\mu$m after adhering to the recording sheet. This kind of printhead can express a greater number of gradation levels by forming ink drops having a wide range of dot diameters.

However, a problem occurs with a printhead which ejects ink drops of a plurality of diameters when printing large diameter drops. If the applied voltage for driving the piezoelectric element is increased in an attempt at forming an ink drop having a relatively large diameter, then anomalies with the printed drop tend to occur which are known variously as break, curve, and satellite of ink drops.

FIGS. 6(*a*)–(*c*) show views for explaining the drop break and satellite of the ink drops. FIG. 6(*a*) shows an ink drop which is propelled in a normal shape. FIG. 6(*b*) shows an ink drop propelled with a drop break. FIG. 6(*c*) shows an ink drop propelled with a satellite.

The break, satellite and other anomalies of the ejected drop cause an image defect which significantly impairs the image quality.

The present invention has been developed for solving the problems as described above, and its object is to provide an inkjet recording apparatus capable of preventing the occurrence of the image defect.

SUMMARY OF THE INVENTION

The present invention addresses the above-described problems by providing an inkjet printer where a piezoelectric member for discharging ink is assisted by an external electric field which acts upon a discharged ink drop.

In a first aspect of the invention, means are provided to apply a time invariant electric field which acts only upon larger ink drops, and which does not act upon small ink drops. In a second aspect of the invention, an electric field is switched on and off in synchronism with the image data to be printed so that large ink drops are assisted by the electric field but small ones are not.

In another aspect of the invention, an electric field is applied during printing of ink drops of all sizes so that the flight of the ink drop is stabilized and the piezoelectric actuating voltage is reduced.

Another aspect of the invention consists of an inkjet recording apparatus capable of discharging ink drops of at least two sizes by means of a piezoelectric element, comprising an electrostatic voltage applying means for applying an electrostatic voltage for assisting a large diameter ink drop to fly.

In each of the above aspects, ink drops are discharged at lower piezoelectric voltages and drop anomalies such as break, curve, satellite and the like, are avoided thereby preventing the occurrence of image defects.

BRIEF DESCRIPTION OF THE DRAWINGS

An inkjet printer according to an embodiment of the present invention will be described below with reference to the drawings which are provided as follows:

FIG. 5 is a graph showing a relationship between a pulse voltage applied to a piezoelectric element and the dot diameter of an ink drop adhering to a recording sheet.

FIG. 6 is a view for explaining the drop break and satellite of an ink drop.

DETAILED DESCRIPTION OF THE PREFERRED EMBODIMENTS

This application is based on Japanese patent application No. 09-024015 filed in Japan, the disclosure of which is incorporated herein by reference.

First Embodiment

Figure 1:
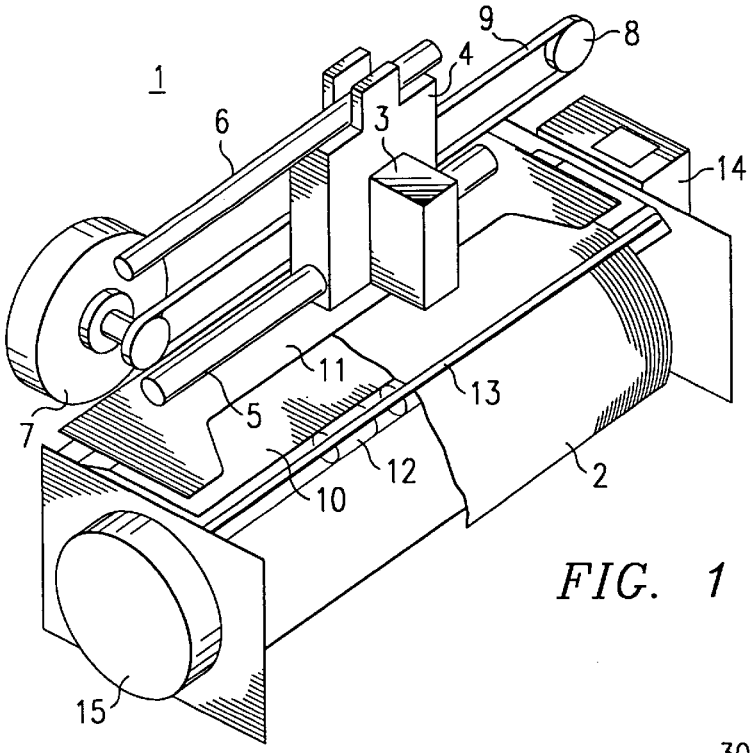
FIG. 1 is a perspective view showing a schematic construction of an inkjet printer 1 according to an embodiment of the present invention.

Referring to FIG. 1, a perspective view is shown of a schematic construction of an inkjet printer 1 according to a first embodiment of the present invention.

The inkjet printer 1 forms an ink image on a recording sheet 2 which serves as a recording medium such as a paper sheet or an OHP sheet. The inkjet printer 1 includes an inkjet head 3 which serves as an inkjet system printhead, a carriage 4 for holding the inkjet head 3, rocking shafts 5 and 6 for reciprocating the carriage 4 in parallel with the recording surface of the recording sheet 2, a driving motor 7 for reciprocally driving the carriage 4 along the rocking shafts 5 and 6, a timing belt 9, and an idling pulley 8 for transforming the rotation of the driving motor 7 into a reciprocating motion of the carriage.

The inkjet printer 1 further includes a bias platen 10 which concurrently serves as a guide plate for guiding the recording sheet 2 along the feed path of the sheet, a sheet pressing plate 11 for pressing the recording sheet 2 located between it and the bias platen 10 to prevent the sheet from lifting up, a discharge roller 12 and a spur roller 13 for discharging the recording sheet 2, a recovery system 14 for recovering ink during a discharge failure of the inkjet head 3, and a paper feeding knob 15 for manually feeding the recording sheet 2. A particular aspect of the present invention is that a bias voltage is applied to the bias platen 10 when discharging a large diameter ink drop as will be described below.

The recording sheet 2 is fed by a paper feeder such as a manual feed or a cut sheet feeder into a recording section where the inkjet head 3 and the bias platen 10 face each other. In this stage, the amount of rotation of a paper feeding roller (not shown) is controlled, so that the feed of the recording sheet relative to the recording section is controlled.

For the inkjet head 3, a piezoelectric element made from a well-known piezoelectric material (e.g., lead zirconate titanate (PZT)) serves as an energy source for ejecting an ink drop. The piezoelectric element changes dimension or deforms when a voltage is applied. This deformation is employed to change the volume of a channel filled with ink. By this change in volume, the ink is discharged from a nozzle provided at the channel, so that recording is executed on the recording sheet 2.

The recording sheet is scanned by the inkjet head in main and sub-scanning directions as follows. The carriage 4 provides for a main scan in the direction of the row of the recording sheet 2 (i.e., in the transverse direction of the recording sheet 2) by means of the driving motor 7, idling pulley 8, and timing belt 9. During the main scan, inkjet head 3 mounted on the carriage 4 records an image of one line. Every time the recording of one line is completed, the recording sheet 2 is fed in the vertical direction for sub-scanning, and recording of the subsequent line is thereby accomplished.

After an image is recorded on the recording sheet 2, the recording sheet 2 is discharged from the recording section by the discharge roller 12 and spur roller 13 which are arranged on the downstream side of the recording section in the feed direction. To discharge the recording sheet 12, the spur roller 13 presses against the discharge roller 12 in order to grip the recording sheet 12.

Figure 2:
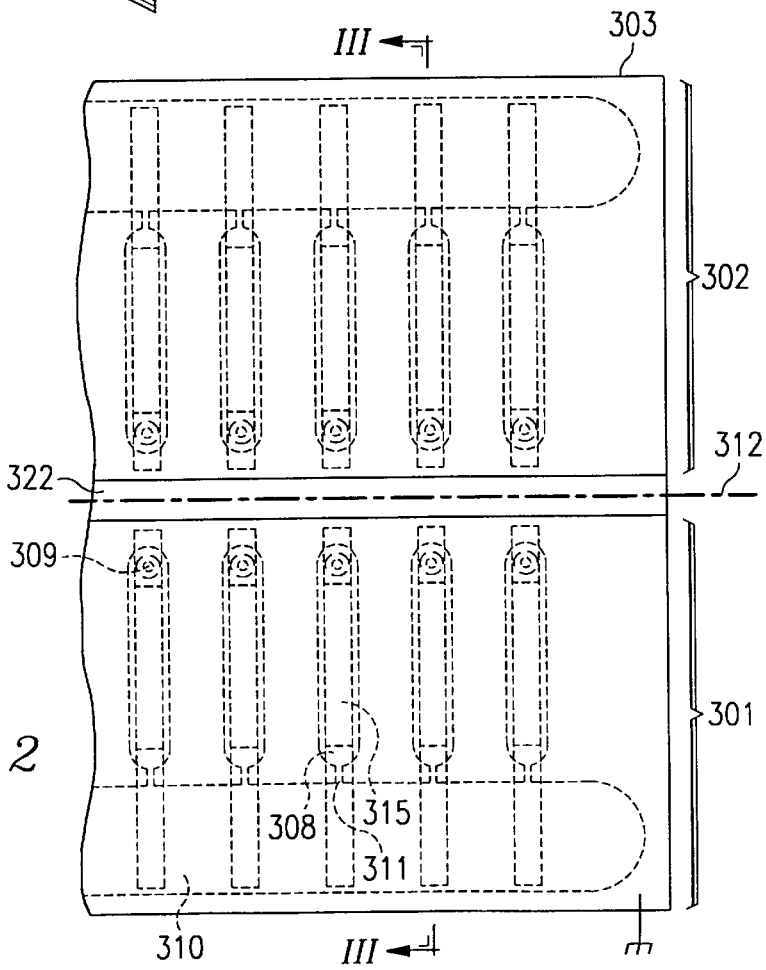
FIG. 2 is a plan view of an inkjet head 3.
Figure 3:
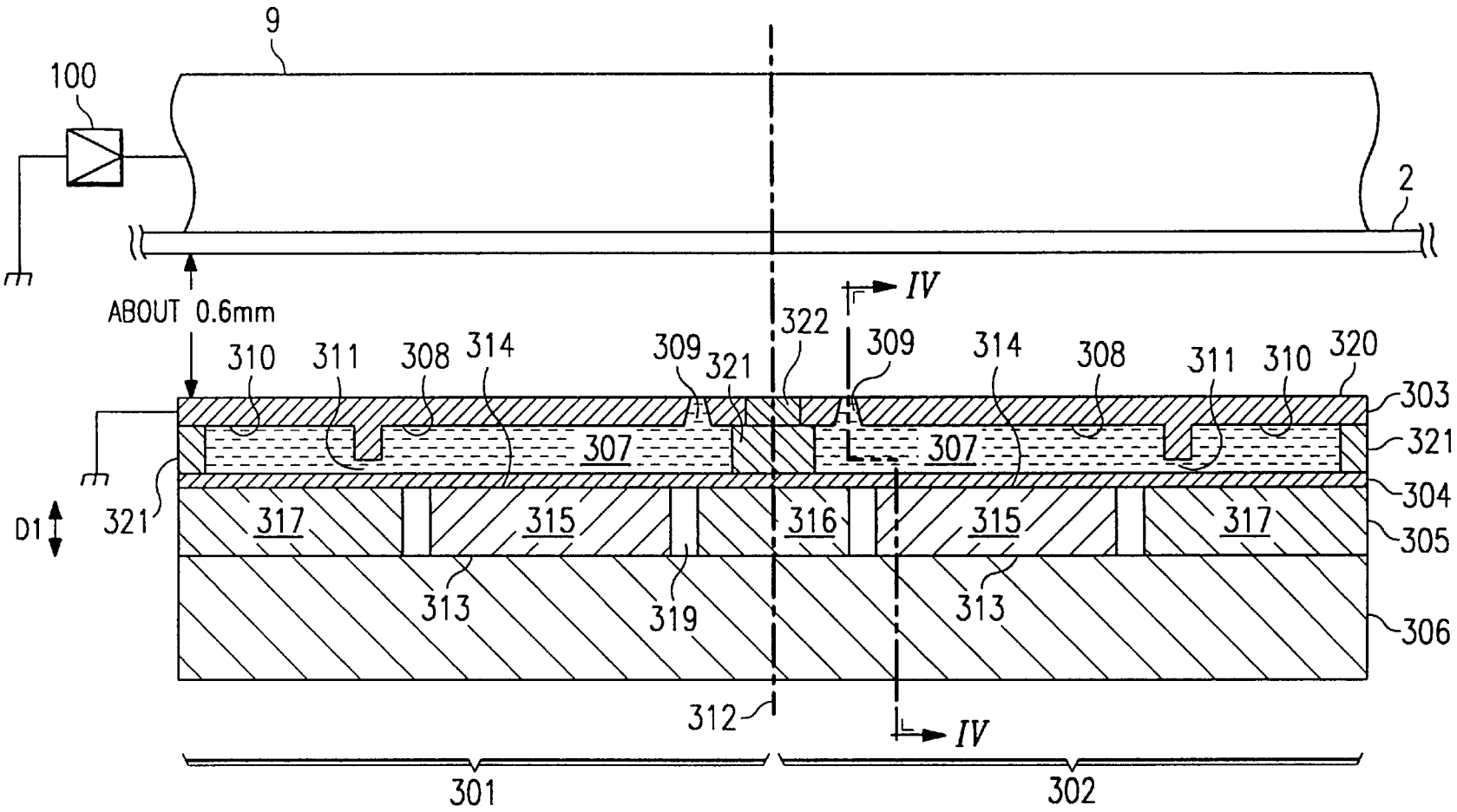
FIG. 3 is a sectional view taken along the line III—III in FIG. 2.
Figure 4:
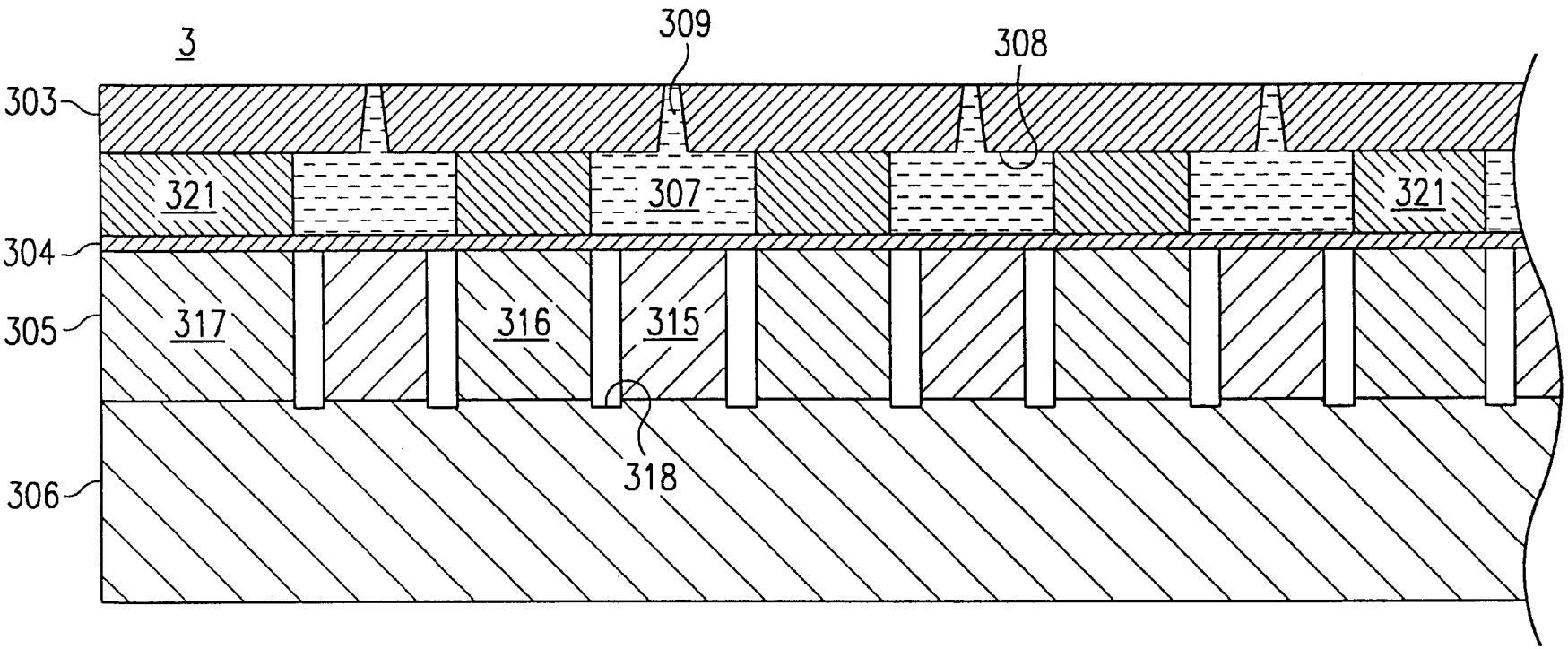
FIG. 4 is a sectional view taken along the line IV—IV in FIG. 3.

Referring to FIGS. 2–4, the construction of the inkjet head 3 will be described next.

Referring to FIG. 2, the inkjet head 3 is comprised of a large diameter dot head 301 and a small diameter dot head 302. The large diameter dot head 301 discharges an ink drop having a diameter larger than that discharged from the small diameter dot head 302. Referring to FIGS. 3 and 4, it can be seen that both the large diameter dot head 301 and small diameter dot head 302 are constructed by integrally stacking a nozzle plate 303, a membrane 304, a piezoelectric member 305 and a base plate 306.

The nozzle plate 303 is made of metal, ceramic or the like. The surface of the nozzle plate 303 which faces the membrane 304 is processed by electroforming, photolithography or the like, to form a plurality of ink channels 308 for storing ink 307 therein; and an ink inlet 311, for connecting each ink channel 308 to an ink supplying chamber 310. The ink channels 308 and ink inlet 311 are formed for both the large diameter dot head 301 and the small diameter dot head 302.

Describing the nozzle plate 303 further, opposite to the surface of the nozzle plate 303 which faces the membrane 304 is a surface 320 which is coated with a water-repellant coating layer. The water-repellant coating layer is an approximately 3-$\mu$m thick electroless plating layer formed by dispersing Teflon having a particle diameter of about 0.2 $\mu$m into an Ni plating liquid. The nozzle plate 303 is divided between the large diameter dot head 301 and the small diameter dot head 302 by an insulating divider 322, and the portion of the nozzle plate associated with the large diameter dot head 301 is grounded. A channel forming wall 321, composed of a material which is not electrically conductive, is arranged between the nozzle plate 303 and the membrane 304.

As shown in FIG. 3, the ink channels 308 of the large diameter dot head 301 and the small diameter dot head 302 are formed in parallel with one another. Each ink channel 308 has an elongated shape which extends in a direction in which the large diameter dot head 301 and the small diameter dot head 302 face each other. Further, the ink supplying chambers 310 and the ink channels 308 are formed symmetrical to each other about a center line 312, and they are connected to an ink tank (not shown).

The membrane 304 consists of a thin film and is fixed between the nozzle plate 303 and the piezoelectric member 305. It is to be noted that the membrane 304 is fixed with a specified tension applied thereto.

The piezoelectric member 305 is divided into a number of smaller elements and includes a piezoelectric element 315 such as a PZT oscillator. The piezoelectric member 305 is to form the print head structure including the smaller elements first by being fixed by an insulating adhesive to the base plate 306. The base plate 306 has a wiring portion on an upper surface of the ceramic facing the piezoelectric member 305. After the piezoelectric member 305 is bonded to the base plate 306, the piezoelectric member 305 is divided by a dicing process which cuts crossed separating grooves 318 and 319. This dividing operation causes a plurality of piezoelectric elements 315 to be separated from the bulk of the piezoelectric member 305. In the assembly, each piezoelectric element 315 is arranged to correspond to one of the ink channels 308, and a portion of the piezoelectric element 315 which contacts the base plate 306 is provided with an electrical contact to the base plate 306 by a conductive adhesive that is applied after the dicing process.

As noted above, each piezoelectric element 315 is separated from the bulk of the piezoelectric member 305 by the cut grooves 318 and 319, thus each piezoelectric element 315 is surrounded on the other sides of the cut grooves 318 and 319 by other parts of the divided piezoelectric member 305. Specifically, a piezoelectric element pillar section 316 is positioned on each transverse side of the piezoelectric element 315, and peripheral walls 317 are positioned at a longitudinal end of the piezoelectric element 315.

Each of the piezoelectric elements 315 are provided with a common electrode 313, which is common to all of the piezoelectric elements and which is connected to ground, and an individual electrode 314, one of which is provided independently for each piezoelectric element.

In this embodiment, each piezoelectric element is made in a laminated structure having a series of alternating layers of internal electrodes and piezoelectric material. The layers are arranged so that they are parallel to the bulkhead 304. Further, in a region where the common electrode 313 and individual electrode 314 face each other, each piezoelectric element 315 is processed to have a net residual polarization by carrying out an elevated temperature polarization process. Although the piezoelectric element in the present embodiment is formed in a laminated structure, each piezoelectric element 315 may also be formed from a single layer of PZT. Additional details about the single layer piezoelectric member and laminated structure piezoelectric member are provided later in reference to FIGS. 10 and 11.

In the inkjet head 3 having the above construction, the ink 307 is supplied from the ink tank (not shown) to the ink supplying chamber 310. The ink 307 in the ink supplying chamber 310 is distributed to the ink channels 308 via the ink inlets 311.

The operation of the inkjet head 3 described above is controlled by a control section of the inkjet printer 1. When a specified voltage is applied across the common electrode 313 and the individual electrodes 314 from the head discharge drive section 105 (see FIG. 9) of the control section, the respective piezoelectric element 315 deforms. The deformation is in a direction such that the piezoelectric element 315 presses against membrane 304. The resulting pressure on membrane 304 causes the ink 307 inside the ink channel 308 to be pressurized and an ink drop to be ejected from the nozzle 309 toward the recording sheet 2.

While the above-described process is used to discharge relatively small diameter ink drops, a different approach is used for large diameter ink drops. For discharging a large diameter ink drop, a bias voltage is applied between the nozzle plate 303 and a bias platen 9. The bias platen 9 faces the nozzle plate 303 with a separation between them of about 0.6 mm, and the recording sheet 2 is disposed between the bias platen and the nozzle plate 303. The bias voltage is generated by an applying circuit 100, which provides a direct current (DC) bias voltage of about 800 V. As a result of the applied DC bias voltage, an ink drop discharged from the nozzle 309 is electrostatically attracted to the bias platen 9. Thus, the ink drop moves toward the recording sheet under forces generated by both the piezoelectric element 315 as well as the applied bias voltage so that the flight of the ink drop initiated by the piezoelectric element 315 is assisted.

FIG. 5 is a graph showing a relationship between the pulse voltage applied to the piezoelectric element and the dot diameter of the discharged ink drop measured when the drop is adhered to the recording sheet. The printed droplet adhered to the recording sheet is referred to herein as a "dot." The piezoelectric element used herein is the laminated PZT comprised of 20 layers, each having a thickness of about 35 $\mu$m. In FIG. 5, the large diameter nozzle corresponds to the nozzle for the above-described large diameter dot head 301, while the small diameter nozzle corresponds to the above-described nozzle for the small diameter dot head 302. The large diameter nozzle has a diameter of about 30 $\mu$m, while the small diameter nozzle has a diameter of about 20 $\mu$m.

The pulse voltage applied to the piezoelectric element has a rectangular waveform shape, a pulse-width of 50 $\mu$sec and is applied at a frequency of 4 kHz. The plotted dot diameter represents the mean value of a plurality of measured dots. The solid black dots indicate the adhered dot diameter which were printed while a bias voltage was applied between the nozzle plate 303 and the bias platen 9. The unfilled white dots indicate the adhered dot diameter which were printed when no bias voltage was applied between the nozzle plate 303 and the bias platen 9.

As shown in FIG. 5, application of a bias voltage between the nozzle plate 303 and the bias platen 9 results in a dot having a greater diameter than where no bias voltage is applied. The observed increase in dot diameter when applying the bias voltage was consistently obtained for each pulse voltage level employed to drive the piezoelectric element 315.

In addition to obtaining increased dot diameter when a bias voltage is applied, other benefits are also obtained. When no bias voltage is applied and a dot is printed at 80V pulse voltage level, see data point "A" on FIG. 5, drop break and satellite anomalies occur in printing. Drop break and satellite are illustrated in FIGS. 6(*b*)–6(*c*). However, when a bias voltage is applied between the nozzle plate 303 and the bias platen 9, printed dots at the 80V pulse voltage level do not exhibit such drop break or satellite anomalies.

Thus, as described above, by applying a bias voltage between the nozzle plate 303 and the bias platen 9 in addition to driving the piezoelectric element when printing a large diameter dot, the ink drop from the nozzle is electrostatically attracted in the direction of flight, so that it smoothly flies without generating the break, curve, satellite and the like, thereby preventing the image defect. It should also be noted that since the nozzle plate 303 is divided between the large diameter dot head 301 and the small diameter dot head 302 by an insulating divider 322, and only the portion of the nozzle plate associated with the large diameter dot head 301 is grounded, the electric field generated by the bias voltage is confined to the region of the large diameter dot head 301.

Although the inkjet head described above has a large diameter nozzle corresponding to the large diameter dot head 301, and a small diameter nozzle corresponding to the small diameter dot head 302, in fact, the diameters of the nozzles may be identical. When the present invention involving the application of a bias voltage between the nozzle plate 303 and a bias platen 9 is applied to an inkjet head having nozzles of an identical diameter, the electrostatic attraction can be selectively applied only to ink drops having a relatively large diameter.

For selective application of the bias voltage when printing only large diameter dots, a switching circuit is connected to the circuit for applying the bias voltage 100, and the switch can be turned on and off in synchronization with a drive signal, so the bias is applied for each ink drop having a large diameter and the bias turned off for each ink drop having a small diameter.

Second Embodiment

In addition to applying a bias between the nozzle plate 303 and a bias platen 9 when printing large diameter dots, it is also possible to apply the bias voltage when printing dots of all sizes. One advantage is an overall reduction in the drive voltage which is necessary to be applied to the piezoelectric elements. With this arrangement, the maximum voltage of a driver IC for driving the piezoelectric elements can be reduced. By using a general-purpose IC (having a lower top voltage), a cost reduction in the inkjet print head can be achieved. Further, by applying the bias voltage to ink drops of all sizes, the ink meniscus of the nozzles can be kept constant by an electrostatic attraction force which has the positive effect of stabilizing the ink flight. Stabilizing the ink flight is particularly important when attempting to very accurately control the printed dot diameter.

Even though the nozzles for the large diameter dot head 301 and the small diameter dot head 302 are the same size, a range of ink drop sizes may still be produced. In this case, by appropriately adjusting the amplitude, pulse width, and so forth, of the pulse voltage waveform for driving the piezoelectric elements, the ink drops can be adjusted to a desired size.

Figure 7:
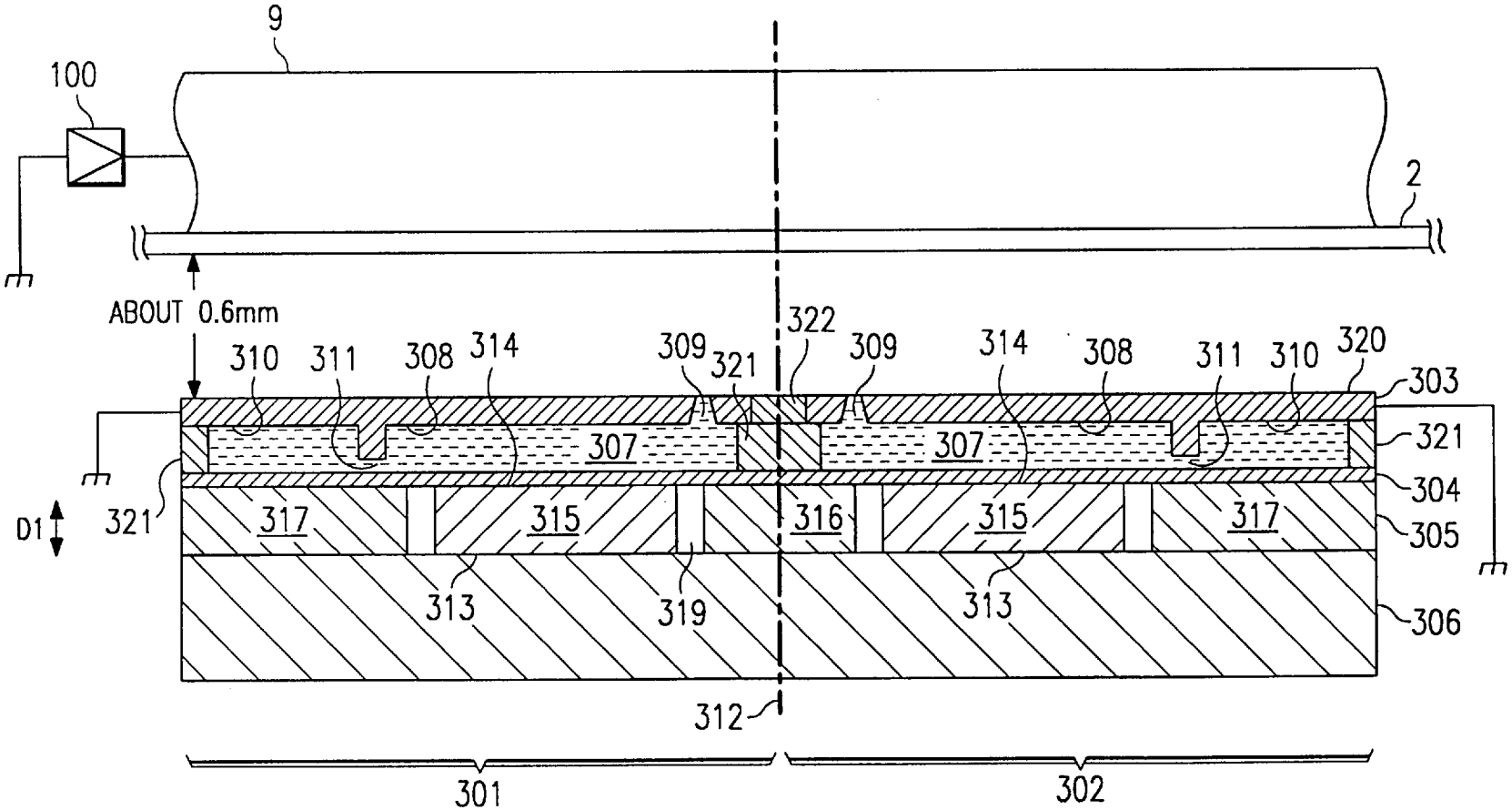
FIG. 7 is a second embodiment of the inkjet head and is a sectional view taken along the line III—III in FIG. 2.

FIG. 7 illustrates the inkjet head of the second embodiment. Many of the structural features in the inkjet head of the second embodiment are the same as the above-described first embodiment and the same reference numerals and letters are used to indicate corresponding elements throughout the figure.

Like the first embodiment, the nozzle plate 303 is divided between the large diameter dot head 301 and the small diameter dot head 302 by an insulating divider 322. Unlike the first embodiment, both the portion of the nozzle plate associated with the large diameter dot head 301, as well as the portion of the nozzle plate associated with the small diameter dot head 302 are grounded.

By grounding the portions of the nozzle plate associated with both the large diameter dot head 301 as well as the small diameter dot head 302, the inkjet printer of this embodiment can form an electrostatic force between the nozzle plate for the small nozzles and the platen.

Figure 8:
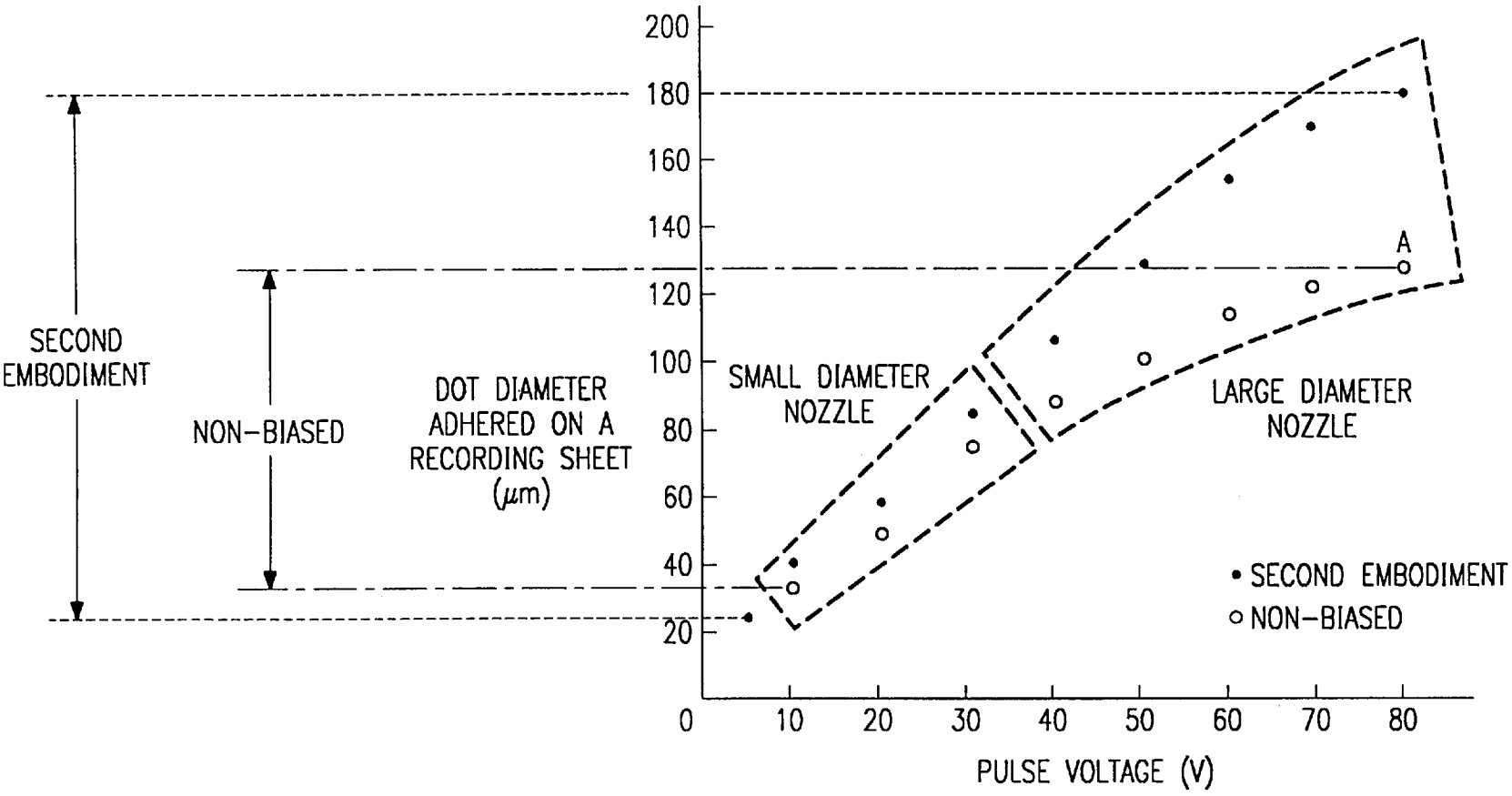
FIG. 8 is a graph showing a relationship between a pulse voltage applied to a piezoelectric element and the dot diameter of an ink drop adhering to a recording sheet for a second embodiment of the inkjet head.

FIG. 8 shows relationship between dot diameter of ink drop adhered on a recording sheet and pulse voltage applied to the nozzle. In this graph, the operational condition of piezoelectric element 315 is identical to the first embodiment shown in FIG. 5. In this figure, black dots show the result of the second embodiment, and white dots show the result of a non-biased case. As seen from the figure, in the non-biased case the minimum diameter of the dot is about 36 $\mu$m upon application of a 10 volt pulse. Below the 10 volt pulse, an ink drop cannot be discharged in the non-biased case. On the other hand, the second embodiment demonstrates that an ink drop can be discharged under a 5 volt pulse application, and a dot of small diameter can be formed. The minimum dot diameter is 26 $\mu$m, which is much smaller than the minimum dot size possible with the non-biased case.

Thus, as understood from above, in the second embodiment, a wider range of dot diameters is possible which permits a more finely detailed multi-tone image to be formed.

As may be understood from the description of the second embodiment, the minimum ink drop which can be printed on the recording sheet under the influence of electrostatic force has a diameter of about 26 $\mu$m. In comparison, the minimum ink drop in the non-biased case is about 36 $\mu$m. Thus, the application of the electrostatic force allows printing of ink drops at least as small as 72% of the diameter possible in the non-biased case. It should be noted that those skilled in the art will recognize that the 36 $\mu$m ink drop described in the non-biased case is already an extraordinarily small drop for inkjet printers presently known. Thus, in view of the very small ink drop which can be printed in the non-biased case, any further reduction in ink drop size, for instance to about 80% diameter (i.e., 29 $\mu$m), will enhance the resolution of the printed image and a reduction of ink drop size all the way to 26 $\mu$m will not be necessary to achieve enhanced resolution.

Also, although the first and second embodiments of the present invention disclose an inkjet head 3, which moves in a main scan in the direction of the row of the recording sheet 2 (i.e., in the transverse direction of the recording sheet 2), this should not be construed as a limitation. A fixed inkjet head, having a width substantially equal to the width of a page may also be provided where the recording sheet 2 is fed in the vertical direction for scanning, and where the fixed inkjet head includes a plurality of ink nozzles disposed across the width of the page. In such a fixed inkjet head, approximately 3307 ink nozzles are required across the width of an A4 page in order to print at a density of 400 dpi.

Details of the Piezoelectric Element and Driver

Figure 9:
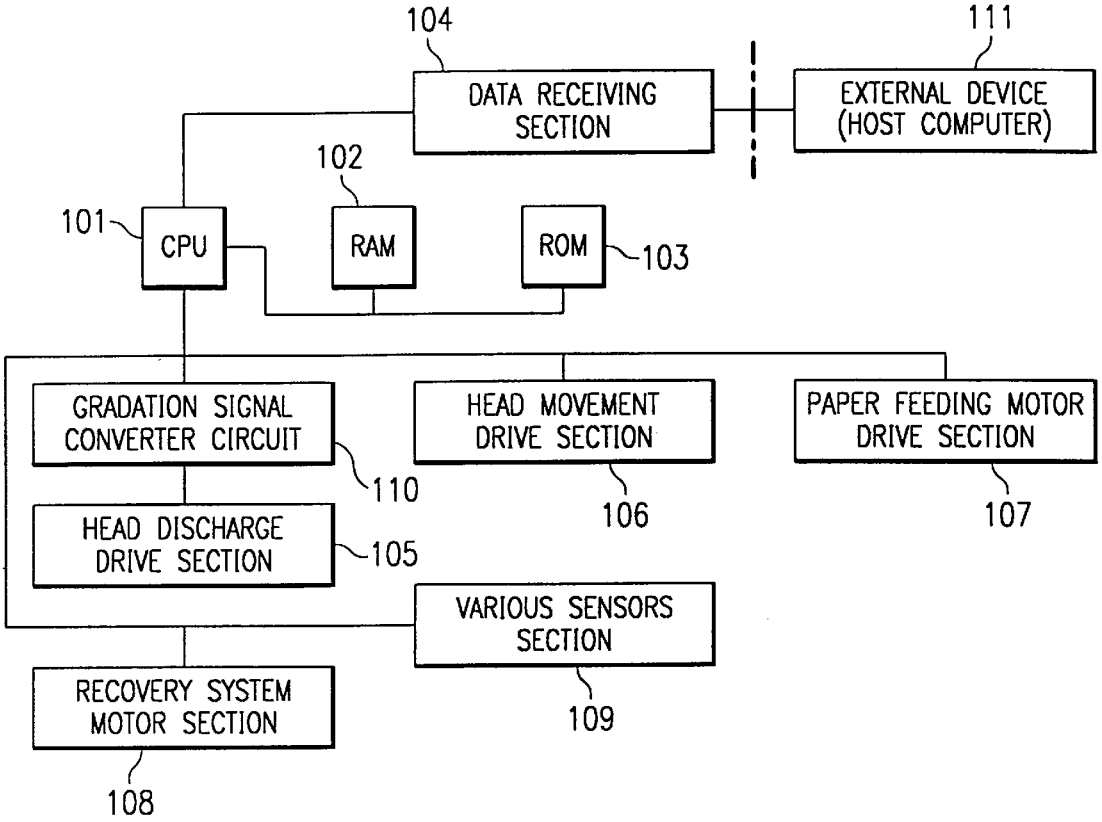
FIG. 9 shows a block diagram for explaining the construction of the control section of the inkjet printer 1.

FIG. 9 shows a block diagram for explaining the construction of the control section of the inkjet printer 1.

The control section of the inkjet printer 1 includes a CPU 101, a RAM 102, a ROM 103, a data receiving section 104, a head discharge drive section 105, a head movement drive section 106, a paper feeding motor drive section 107, a recovery system motor drive section 108 and various sensors section 109. A gradation signal converter circuit 110 is provided between the CPU 101 and the head discharge drive section 105.

The CPU 101, which controls the entire system, executes a program stored in the ROM 103 and uses the RAM 102 at need. This program includes a portion for forming an image on the recording sheet 2 based on image data to be recorded and a portion for recovering the nozzle surface of the printhead 3 into a satisfactory state as the occasion demands. The portion for forming an image includes the processing in connection with an external device 111, such as a host computer, for receiving the image data to be recorded via the data receiving section 104 and recording an image on the recording sheet 2 by controlling the head discharge drive section 105, head movement drive section 106, paper feeding motor drive section 107, and various sensors section 109 based on the image data. The portion for the recovery includes the processing for recovering the nozzle surface of the printhead 3 into a satisfactory state by controlling the recovery system motor drive section 108 and the various sensors section 109.

Under the control of the CPU 101, the gradation signal converter circuit 110 converts an 8-bit image signal to a rectangular pulse voltage having a pulse amplitude corresponding to the gradation level of image data. Thus, the converter circuit 110 generates a signal to be supplied to the head discharge drive section 105, and the head discharge drive section 105 drives the piezoelectric elements 313 of the printhead 3 on the basis of this signal. The head discharge drive section 105 converts the pulse voltage received from the converter circuit 110 to a form suitable for deforming the PZT. Under the control of the CPU 101, the head movement drive section 106 drives the driving motor 7 for moving the carriage 4 which holds the printhead 3 in the direction of the row, and the paper feeding motor drive section 107 drives the paper feeding roller. Further, under the control of the CPU 101, the recovery system motor drive section 108 drives motors and so forth necessary for recovering the nozzle surface of the printhead 3 into a satisfactory state.

As noted above, the piezoelectric element changes dimension or deforms when a voltage is applied. The piezoelectric element 315 is processed by an elevated temperature polarization process in a region where the common electrode 313 and individual electrode 314 face each other. The result of the polarization process is to create a net residual polarization in the piezoelectric material, where the direction of polarization is determined. The direction of polarization of the piezoelectric element 315, and the orientation of the common electrode 313 and individual electrode 314 relative to the polarization direction determines the direction in which the piezoelectric element changes dimension or deforms when a voltage is applied.

Figure 10:
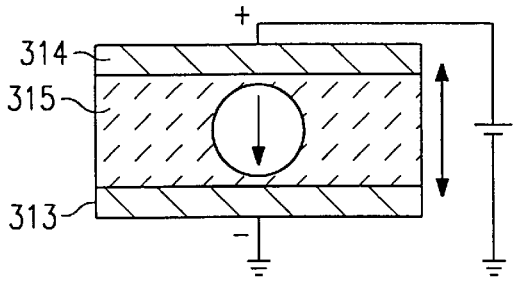
FIG. 10 illustrates a single layer piezoelectric element 315 having a common electrode 313 and individual electrode 314 attached thereto.

FIG. 10 illustrates a single layer piezoelectric element 315 having a common electrode 313 and individual electrode 314 attached thereto. The polarization direction is indicated by the arrow. In this configuration, when a bias voltage is applied between the common and individual electrodes, as is illustrated in FIG. 10 by the battery circuit, the piezoelectric member 315 deforms.

Figure 11:
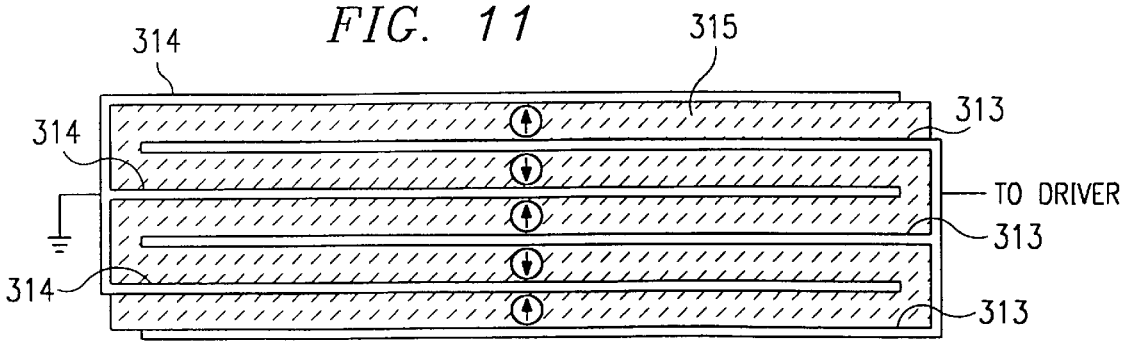
FIG. 11 illustrates a multi-layered type of piezoelectric.

FIG. 11 illustrates a multi-layered type of piezoelectric. In this configuration, alternating layers of piezoelectric elements 315, common electrodes 313, and individual electrodes 314 are assembled. For each piezoelectric elements 315, the circled arrow represents the polarized direction of the respective layer. By applying drive voltage to individual electrode, the PZT expands in the up-and-down direction. That is, the polarized direction of each of the PZT layers, the direction of drive voltage, and the deformation direction of the PZT are identical. By employing this structure, the PZT can deform very quickly, and therefore, it is effective to form an ink drop of small diameter.

FIGS. 10 and 11 illustrate examples of piezoelectric members where a bias voltage applied between the individual electrode 314 and common electrode 313 would form an electric field having a direction parallel to the polarization direction. It is also possible to orient the applied electric field and the polarization direction of the piezoelectric member so that the electric field direction and polarization direction are transverse to each other. In both cases, the piezoelectric member will deform upon application of a bias voltage. The present inventor, however, has discovered that in the case where the direction of the applied electric field and the direction of polarization of the piezoelectric member are parallel, the rate of deformation of the piezoelectric member upon application of a bias voltage is ten times greater than the case where the direction of the applied electric field and the direction of polarization of the piezoelectric member are transverse. Accordingly, an inkjet printhead having a piezoelectric member where the direction of the applied electric field and the direction of polarization of the piezoelectric member are parallel, can print at higher print frequencies as well as print drops of smaller diameter.

Although the present invention has been fully described by way of examples and with reference to the accompanying drawings, it is to be understood that various changes and modifications will be apparent to those skilled in the art without departing from the spirit and scope of the invention. Therefore, unless such changes and modifications depart from the scope of the present invention, they should be construed as being included therein.

What is claimed is:

1. An inkjet recording apparatus for forming a half-tone image on a recording sheet by ejecting ink drops from an ink chamber, said inkjet recording apparatus comprising:

an inkjet head comprising:

a plurality of ink chambers, each of said plurality of ink chambers having a wall, each of said plurality of ink chambers having a nozzle for ejecting an ink drop therethrough; and a plurality of electro-mechanical transducers, each electro-mechanical transducer having a first surface, each of said electro-mechanical transducers confronting one of said ink chambers, said first surface of each of said electro-mechanical transducers being in contact with said wall of said ink chamber;

a driver which drives each of said electro-mechanical transducers in accordance with gradations of input image data for electing ink drops, wherein said driver drives said electro-mechanical transducer by applying a drive voltage to said electro-mechanical transducer, said drive voltage having a waveform which varies with the gradation of said image data; and an assisting means for assisting the ejection of ink drops by applying an electrical attraction force between said inkjet head and the recording sheet;

wherein said electro-mechanical transducer deforms in response to the drive voltage, wherein said assisting means for assisting the ejection of ink drops assists the ejection of ink drops from only a portion of said ink chambers, said portion of said ink chambers being less than all of said plurality of ink chambers.

2. An inkjet recording apparatus in accordance with claim 1, wherein each electro-mechanical transducer has a polarization direction perpendicular to said first surface, and wherein said drive voltage applied to said electro-mechanical transducer generates an electric field in a direction parallel to said polarization direction.

3. An inkjet recording apparatus in accordance with claim 1, wherein each electro-mechanical transducer is made in a laminated structure having a plurality of alternating layers of each of internal electrodes and piezoelectric material.

4. An inkjet recording apparatus in accordance with claim 1, wherein each electro-mechanical transducer has a second surface opposing said first surface, said inkjet head further comprising a base plate having a surface to which said second surface of each electro-mechanical transducer is disposed, and wherein each electro-mechanical transducer deforms in the direction of the polarization direction in response to a drive voltage.

5. An inkjet recording apparatus for forming a half-tone image on a recording sheet by ejecting ink drops from an ink chamber, said inkjet recording apparatus comprising:

a first inkjet head which includes a first ink chamber and a first nozzle from which ink accommodated in said first ink chamber is ejected, said first nozzle having a first diameter;

a second inkjet head which includes a second ink chamber and a second nozzle from which ink accommodated in said second ink chamber is ejected, said second nozzle having a second diameter which is different than said first diameter; and an assisting means for assisting the ejection of the ink drops by applying an electrical attraction force between said inkjet heads and the recording sheet;

wherein said assisting means assists the ejection of ink drops from only one of said first inkjet head and said second inkjet head.

6. An inkjet recording apparatus in accordance with claim 5, further comprising a switching means to switch on and off said assisting means;

wherein said assisting means applies an electrical attraction force between both of said first and second inkjet heads and the recording sheet, and wherein said assisting means is switched on by said switching means in synchronism with printing from said first inkjet head and is switched off by said switching means in synchronism with printing from said second inkjet head so that said assisting means assists the ejection of the ink drops from only said first inkjet head.

7. An inkjet recording apparatus for forming a half-tone image on a recording sheet by ejecting ink drops from an ink chamber, said inkjet recording apparatus comprising:

an inkjet head comprising:

a membrane having a first surface and a second surface opposing said first surface;

a plate on which a plurality of channels are formed, said plate being in contact with said first surface of said membrane so that each of said channels is covered with said membrane, a space formed between each of said channels and said membrane being defined as an ink chamber, each of said plurality of ink chambers having a nozzle for electing an ink drop therethrough; and a plurality of electro-mechanical transducers each of which has a first surface, each of said electro-mechanical transducers being in contact with said second surface of said membrane opposite one of said plurality of ink chambers, said first surface of each electro-mechanical transducer being in contact with said second surface of said membrane;

a driver which drives each of said electro-mechanical transducers in accordance with gradations of input image data for electing ink drops, said drive voltage having a waveform which varies with the gradation of said image data;

a bias platen, said bias platen positioned adjacent to said inkjet head and spaced apart therefrom so that a recording sheet to receive a discharged ink drop may be positioned between the bias platen and the inkjet head; and an electric field generating device for generating an electric field between said inkjet head and said bias platen so that the ejection of ink drops is assisted;

wherein said electric field generating device for assisting the ejection of the ink drops assists the ejection of ink drops from only a portion of said ink chambers, said portion of said ink chambers being less than all of said plurality of ink chambers.

8. An inkjet recording apparatus in accordance with claim 7, wherein each of said electro-mechanical transducers has a polarization direction perpendicular to said first surface, and wherein said driver drives said electro-mechanical transducer by applying a drive voltage to said electro-mechanical transducer in a direction parallel to said polarization direction.

9. An inkjet recording apparatus in accordance with claim 7, wherein said plate includes a top water-repellant coating.

10. An inkjet recording apparatus in accordance with claim 9, wherein said electric field is formed between said water-repellant coating and said bias platen.

11. An inkjet recording apparatus in accordance with claim 10, wherein said water-repellant coating layer is an approximately 3-$\mu$m thick electroless plating layer formed by dispersing polytetrafluoroethylene (PTFE) having a particle diameter of about 0.2 $\mu$m into an Ni plating liquid.

12. An inkjet recording apparatus in accordance with claim 7, wherein said plate includes first and second electrically conductive portions and an electrically insulating divider interposed between said first and second conductive portions so that electrical continuity is substantially prevented between said first and second conductive portions, and wherein said electric field is formed between said first conductive portion and said bias platen, and wherein said electric field is not formed between said second conductive portion and said bias platen.

13. An inkjet recording apparatus in accordance with claim 7, wherein each electro-mechanical transducer is made in a laminated structure having a plurality of alternating layers of internal electrodes and piezoelectric material.

14. An inkjet recording apparatus in accordance with claim 7, further comprising a switching means to control said electric field generating device, wherein said switching means selectively switches said electric field generating device on and off so that said electric field generating device generates an electric field between said nozzle plate and said bias platen in accordance with the gradation of said image data.

15. An inkjet recording apparatus in accordance with claim 7, wherein each electro-mechanical transducer has a second surface opposing said first surface, said inkjet head further comprising a base plate having a surface to which said second surface of each electro-mechanical transducer is disposed, and wherein each electro-mechanical transducer deforms in the direction of the polarization direction in response to a drive voltage.

16. A method of forming a half-tone image on a recording sheet by ejecting ink drops from an ink chamber comprising the steps of:

providing a first inkjet head which includes a first ink chamber and a first nozzle from which ink accommodated in said first ink chamber is ejected, said first nozzle having a first diameter;

providing a second inkjet head which includes a second ink chamber and a second nozzle from which ink accommodated in said second ink chamber is ejected, said second nozzle having a second diameter which is different than said first diameter; and selectively generating an electrical attraction force between at least one of said first and second inkjet heads and the recording sheet for selectively assisting the ejection of the ink drops.

17. A method of forming a half-tone image in accordance with claim 16, wherein said step of selectively generating an electrical attraction force generates an electrical attraction force between said first inkjet head and the recording sheet and does not generate an electrical attraction force between said second inkjet head and the recording sheet.

18. A method of forming a half-tone image in accordance with claim 17, wherein said electrical attraction force between said first inkjet head and the recording sheet is substantially time and image data invariant during operation of the apparatus.

19. A method of forming a half-tone image in accordance with claim 16, further comprising a step of switching the electrical attraction force on in synchronism with printing from said first inkjet head and is switched off by said switching means in synchronism with printing from said second inkjet head so that said electrical attraction force selectively assists the ejection of the ink drops from only said first inkjet head.

20. An inkjet recording apparatus for forming a half-tone image on a recording sheet by ejecting ink drops from an ink chamber, said inkjet recording apparatus comprising:

an inkjet head including a plurality of electro-mechanical transducers;

a driver which drives said electro-mechanical transducers in accordance with gradations of input image data, wherein said driver drives said electro-mechanical transducers by supplying a drive voltage to said inkjet head, said drive voltage having a waveform which varies with the gradation of said image data; and an assisting means for assisting the ejection of the ink drops by applying an electrical attraction force between said inkjet head and the recording sheet;

wherein said drive voltage applied to said electro-mechanical transducer generates an electric field in a direction parallel to a polarization direction of said electro-mechanical transducers, and said electro-mechanical transducer deforms in the polarized direction in response to the drive voltage, and wherein said inkjet recording apparatus is adapted to eject ink drops having an adhered drop diameter of less than about 36 $\mu$m.

21. An inkjet recording apparatus in accordance with claim 20, wherein said drive voltage applied to said electro-mechanical transducer to deform said electro-mechanical transducer is insufficient to eject an ink drop without the assistance of said assisting means.

22. A method of using an inkjet recording apparatus for ejecting an ink drop to form an adhered dot, said method comprising the steps of:

providing an inkjet head, said inkjet head including an electro-mechanical transducer;

supplying a drive voltage to said electro-mechanical transducer, said electro-mechanical transducer deforming in response to the drive voltage;

providing an assisting means for assisting the ejection of the ink drop by applying an electrical attraction force between said inkjet head and the recording sheet; and ejecting an ink drop under a combined action of said electro-mechanical transducer deforming in response to the drive voltage and said assisting means, said ink drop having an adhered dot diameter of less than about 36 $\mu$m.

23. A method of using an inkjet recording apparatus in accordance with claim 22, wherein in said step of supply a drive voltage to said electro-mechanical transducer, said drive voltage applied to said electro-mechanical transducer generates an electric field in a direction parallel to a polarization direction of said electro-mechanical transducer, and said electro-mechanical transducer deforms in the polarized direction in response to the drive voltage.

24. A method of using an inkjet recording apparatus which comprises an inkjet head for forming an ink dot on a recording sheet, said inkjet head including an ink chamber and an electro-mechanical transducer for ejecting an ink drop from said ink chamber, said method comprising the steps of:

supplying a drive voltage to said electro-mechanical transducer, said electro-mechanical transducer deforming in response to the drive voltage;

applying an electrical attraction force between said inkjet head and the recording sheet; and forming a first ink dot on a recording sheet by ejecting an ink drop under a combined action of said electro-mechanical transducer deforming in response to the drive voltage and said application of the electrical attraction force, said first ink dot having a diameter smaller than a diameter of a second ink dot which is the smallest dot capable of being formed by ejecting an ink drop under an action of said electro-mechanical transducer deforming in response to said drive voltage without application of the electrical attraction force.

25. A method of using an inkjet recording apparatus in accordance with claim 24, wherein said steps of forming said first ink dot and said second ink dot, first ink dot has a diameter less than 80% of the diameter of the second ink dot.

26. The method of using an inkjet recording apparatus in accordance with claim 24, wherein in said step of supply a drive voltage to said electro-mechanical transducer, said drive voltage applied to said electro-mechanical transducer generates an electric field in a direction parallel to a polarization direction of said electro-mechanical transducer, said electro-mechanical transducer deforming in the polarization direction in response to the drive voltage.

* * * * *

UNITED STATES PATENT AND TRADEMARK OFFICE

CERTIFICATE OF CORRECTION

PATENT NO. : 6,036,302
DATED : March 14, 2000
INVENTOR(S) : Hideo Hotomi

It is certified that error appears in the above-identified patent and that said Letters Patent is hereby corrected as shown below:

On the front page [54] Title:, delete "INKJET RECORDING APPARATUS", and insert INKJET --RECORDING APPARATUS AND METHOD WITH SELECTIVE ELECTROSTATIC INK ASSISTANCE--.

Column 10, line 64 (claim 7, line 13), delete "electing", and insert --ejecting--.

Column 11, line 8 (claim 7, line 24), delete "electing", and insert --ejecting--.

Signed and Sealed this

Fifth Day of June, 2001

Nicholas P. Godici

NICHOLAS P. GODICI

*Acting Director of the United States Patent and Trademark Office*

*Attest:*

*Attesting Officer*

UNITED STATES PATENT AND TRADEMARK OFFICE

CERTIFICATE OF CORRECTION

PATENT NO. : 6,036,302
DATED : March 14, 2000
INVENTOR(S) : Hideo Hotomi

It is certified that error appears in the above-identified patent and that said Letters Patent is hereby corrected as shown below:

Title page,
Item [54], delete "INKJECT RECORDING APPARATUS", and insert
-- INKJET RECORDING APPARATUS AND METHOD WITH SELECTIVE ELECTROSTATIC INK ASSISTANCE --.

Column 10,
Line 64, delete "electing", and insert -- ejecting --.

Column 11,
Line 8, delete "electing", and insert -- ejecting --.

This certificate supercedes Certificate of Correction issued June 5, 2001.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,036,302
DATED : March 14, 2000
INVENTOR(S) : Hideo Hotomi

It is certified that error appears in the above-identified patent and that said Letters Patent is hereby corrected as shown below:

Title page,
Item [54], delete "INKJET RECORDING APPARATUS", and insert
-- INKJET RECORDING APPARATUS AND METHOD WITH SELECTIVE ELECTROSTATIC INK ASSISTANCE --.

Column 10,
Line 64, delete "electing", and insert -- ejecting --.

Column 11,
Line 8, delete "electing", and insert -- ejecting --.

This certificate supercedes Certificate of Correction issued March 12, 2002.

Signed and Sealed this

Twentieth Day of August, 2002

*Attest:*

*Attesting Officer*

JAMES E. ROGAN
*Director of the United States Patent and Trademark Office*